US006788913B1

(12) United States Patent
Aoki et al.

(10) Patent No.: US 6,788,913 B1
(45) Date of Patent: Sep. 7, 2004

(54) IMAGE FORMING APPARATUS METHOD AND DEVELOPING DEVICE TO OBTAIN A STABLE IMAGE DENSITY

(75) Inventors: Katsuhiro Aoki, Yokohama (JP); Takatsugu Fujishiro, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/535,158

(22) Filed: Mar. 24, 2000

(30) Foreign Application Priority Data

Mar. 24, 1999 (JP) ..... 11-079824

(51) Int. Cl.[7] ..... G03G 15/08
(52) U.S. Cl. ..... 399/279
(58) Field of Search ..... 399/279, 265, 399/222, 274, 284

(56) References Cited

U.S. PATENT DOCUMENTS

| | | | | | |
|---|---|---|---|---|---|
| 4,780,741 | A | * | 10/1988 | Wada et al. | 399/267 |
| 5,086,728 | A | * | 2/1992 | Kinoshita | 399/281 |
| 5,625,441 | A | * | 4/1997 | Sugiyama et al. | 399/272 |
| 5,689,784 | A | * | 11/1997 | Shin et al. | 399/285 |
| 6,087,056 | A | * | 7/2000 | Toyoshima et al. | 430/102 |
| 6,112,043 | A | * | 8/2000 | Sakuraba | 399/281 |
| 6,266,073 | B1 | * | 7/2001 | Yergenson | 347/115 |

FOREIGN PATENT DOCUMENTS

| | | | |
|---|---|---|---|
| JP | 06027778 A | | 2/1994 |
| JP | 8-297413 A | * | 11/1996 |
| JP | 09197781 A | | 7/1997 |
| JP | 9-211986 | * | 8/1997 |
| JP | 10221914 A | | 8/1998 |
| JP | 11024388 A | | 1/1999 |
| JP | 11084845 A | | 3/1999 |

* cited by examiner

*Primary Examiner*—Quana Grainger
(74) *Attorney, Agent, or Firm*—Oblon, Spivak, McClelland, Maier & Neustadt, P.C.

(57) ABSTRACT

An image forming apparatus includes a latent image bearing member and a developing device for performing a two-level developing operation according to a threshold value of a potential on the latent image bearing member using a one-component developer including toner particles. The developing device has a conveyor to convey the developer to a developing area where the conveyor is spaced from the opposing latent image bearing member by a developing gap. The developing device also has a thin layer forming device to form the developer on the conveyor into a uniform thin layer. A developing bias voltage is applied to the conveyor when the two-level developing operation is performed and developing conditions are established such that an amount of the developer that is moved to and adheres to the latent image bearing member image area is saturated.

27 Claims, 3 Drawing Sheets

IMAGE FORMING APPARATUS METHOD AND DEVELOPING DEVICE TO OBTAIN A STABLE IMAGE DENSITY

BACKGROUND OF THE INVENTION

1. Field of the Invention

The present invention relates to an image forming apparatus, method and developing device for use in image forming apparatus, such as copying machines, facsimile machines, printers, and so forth, and more particularly relates to a developing device capable of obtaining stable image density.

2. Discussion of the Background

In recent years, the use of digital type image forming apparatus, in which an image is formed on the basis of digital image data instead of analog image data has seen an increasing demand. In an image forming operation using digital image data, the density of pixels is not successive, i.e., the density of pixels occurs in a stepwise fashion due to the nature of digital data. Digital image forming apparatus using such digital image data are divided into two types, i.e., one type that expresses the density of pixels using two (binary) levels and another type that expresses the density of pixels using multiple levels.

SUMMARY OF THE INVENTION

Applicants have determined that the digital image forming apparatus of the type using two levels to express pixel density have drawbacks associated with developing devices usually found therein. Applicants have further determined that these drawbacks relate to the use of a developer-toner having a predetermined density that does not properly adhere to an image portion on a photoconductor being used as a latent image bearing member. Not only does this toner not properly adhere where it should (i.e., an image portion), there is the further drawback that toner improperly adheres to a part on the latent image bearing member other than the image portion, i.e., a background portion, which results in forming an image not having proper pixel density and having a dirty background. Further, Applicants have determined that the developing performance of the aforementioned developing device changes depending on the environmental conditions found where the developing device is installed and/or after a period of time has elapsed which means that the dot in each pixel forming the image may not be stably formed.

The present invention has been made in view of the above discussed and other problems and addresses the above discussed and other problems. A preferred embodiment of the present invention provides a novel digital image forming apparatus of the type using two levels and a developing device for use in this digital image forming apparatus of type using two levels, as well as a method of developing a latent image capable of obtaining a stable density for the developed image.

According to a preferred embodiment of the present invention, an image forming apparatus includes a latent image bearing member having a photoconductive surface with a latent image including image areas, at least some of the image areas having different image potential values thereon and a developing device for performing a two-level developing operation with a one-component developer including toner particles. The developing device further includes a conveyor member to convey the one-component developer from a supply and to deliver the one-component developer with a predetermined charge to a developing region where a conveyor surface portion of the conveyor member is closely spaced from and opposed to a photoconductive surface portion of the latent image bearing member, a thin layer forming device to form the developer on the developer-bearing member into a uniform thin layer, and a voltage source to apply a developing bias voltage to the conveyor member when the two-level developing operation is performed to move at least some of the one-component developer with a predetermined charge adhering to the conveyor surface portion to the photoconductive surface portion to form saturated amounts of the one-component developer on the image areas of the photoconductive surface portion wherein the saturated amounts do not charge with increases of the image potential above a predetermined threshold value to provide an image having a density determined by the saturated amounts.

In one aspect of the preferred embodiment, an adhering amount of the developer on the conveyor member is about 0.5 mg/cm$^2$.

In another aspect of the preferred embodiment, the developing region includes a developing gap formed to be equal to or less than about 150 $\mu$m.

In another aspect of the preferred embodiment, the absolute value of the predetermined charge of the one-component developer adhering to the conveyor surface portion is equal to or less than about 10 $\mu$C/g.

In another aspect of the preferred embodiment, substantially all of the one-component developer on the conveyor surface portion is moved during the forming of the saturated amounts.

In another aspect of the preferred embodiment, the developing bias voltage applied to the developer-bearing member is an AC voltage superimposed on a DC voltage with the AC voltage having a peak-to-peak voltage value of 600 to 1200 volts and a frequency of 2 to 6 kHz.

In another aspect of the preferred embodiment, the thin layer forming device protrudes a length of 10 to 15 mm.

In another aspect of the preferred embodiment, the thin layer forming device contacts the developer-bearing member with a contact pressure of from about 10 to about 150 g/cm.

In another aspect of the preferred embodiment, the developer-bearing member is provided with a surface roughness of from about 1 to about 4 $\mu$m RZ.

In another aspect of the preferred embodiment, the thin layer forming device forms a uniform thin layer having a height corresponding to 1 to 1.5 times a diameter of the toner particles.

According to still another aspect of the preferred embodiment of the present invention, an absolute value of the predetermined charge of the one-component developer is set equal to or less than about 10 $\mu$C/g.

BRIEF DESCRIPTION OF THE DRAWINGS

A more complete appreciation of the present invention and many of the attendant advantages thereof will be readily obtained as the same becomes better understood by reference to the following detailed description when considered in conjunction with the accompanying drawings, in which.

DESCRIPTION OF THE PREFERRED EMBODIMENTS

Figure 1:
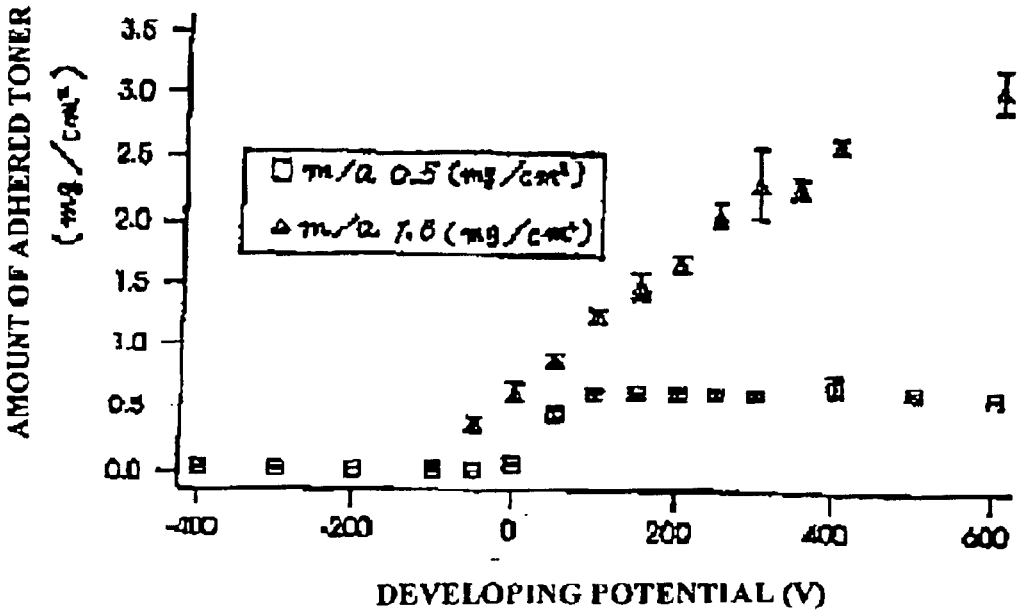
FIG. 1 is a graph illustrating a developing gamma performance of a developing potential and an adhering amount of toner on a photoconductor drum in a developing device of the present invention when the adhering amount of toner on a developing roller is used as a parameter.

The preferred embodiments of the present invention are now described in detail referring to the drawings, wherein like reference numerals indicate identical or corresponding parts throughout the several views.

Figure 2:
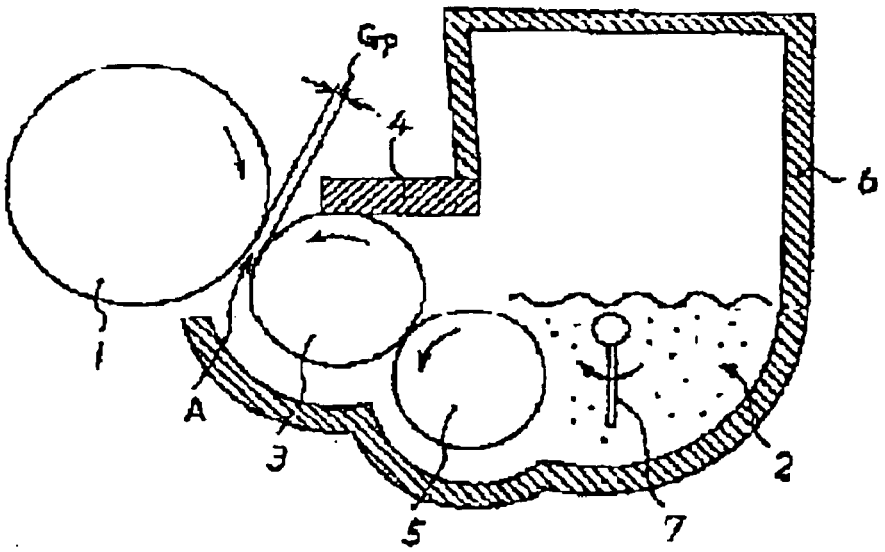
FIG. 2 is a drawing illustrating a schematic construction of the developing device of the present invention.

FIG. 2 is a cross-section illustrating a developing device of a copying machine according to an embodiment of the present invention, which develops a latent image formed on an image-bearing member according to binary image information. The developing device includes a developing roller 3 acting as a developer conveyor member that conveys a toner 2 as a one-component developer to a developing region A, where the developing roller 3 has a surface portion opposed to a photoconductive drum 1 surface portion. The drum 1 serves as an image-bearing member. The developing device also includes a doctor blade 4 to form the toner 2 borne on the developing roller 3 into a uniform thin layer of the toner 2, and a toner-supplying supplying roller 5 to supply the toner 2 to the developing roller 3. The developing device includes a toner container 6 to contain the toner 2 to be supplied to the developing roller 3 by the toner-supplying roller 5, and an agitator 7 that conveys the toner 2 contained in the toner container 6 to the toner-supplying roller 5 while agitating the toner 2.

The toner 2 used in the developing device may be a non-magnetizable toner whose particle diameter is, for example, 5 to 7.5 $\mu$m. The toner includes resin materials, such as polyol resins, polyester resins, and styrene acrylic resins, to which charge control agents and additives are added. Salicylic acid may be used as the charge control agent, and silica, titanium oxide, and the like may be used as the additives.

Figure 3:
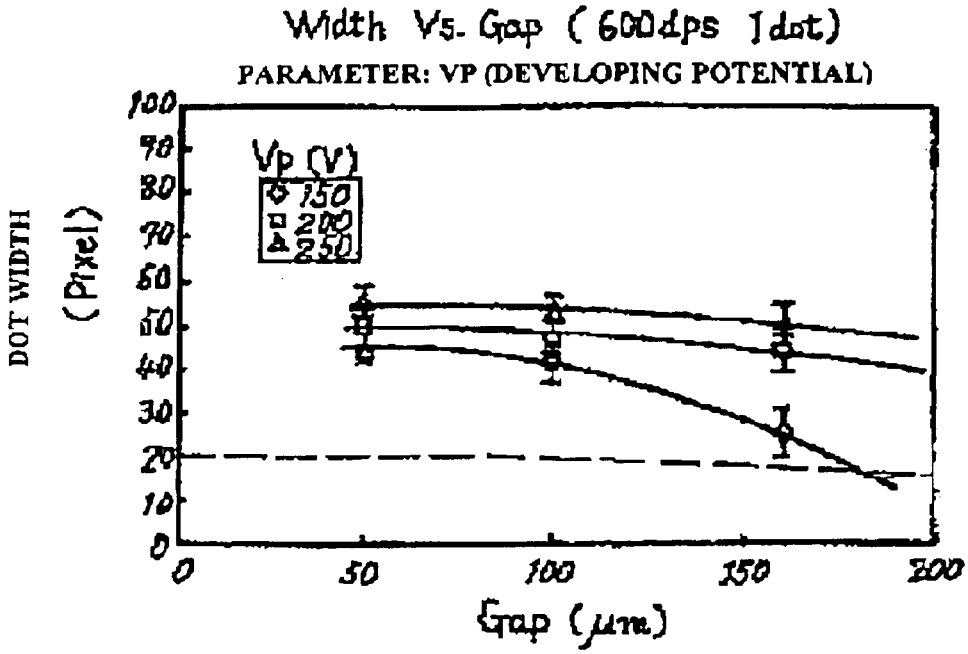
FIG. 3 is a graph illustrating a relationship between a developing gap and a dot width in the developing device of the present invention when a developing potential is used as a parameter.

As illustrated in FIG. 2, the developing roller 3 has a surface portion that is opposed to a surface of the photoconductive drum 1 at the developing region A. This developing region A includes a predetermined developing gap Gp to perform a non-contact developing operation. The preferable developing gap Gp may be 150 $\mu$m or less. FIG. 3 illustrates the results of an experiment performed to obtain a relationship between the developing gap and a dot width of a developed toner image, where Vp represents a developing potential. The results were obtained under the condition that a DC voltage was superimposed with an AC voltage having a rectangular waveform with a peak-to-peak voltage value $V_{p\text{-}p}$ of 1200 V and a frequency of 2 kHz. The superimposed voltages were then applied to the developing roller 3.

As can be understood from the results when the developing gap Gp becomes larger than 150 $\mu$m, the dot width of the toner image falls below 30 $\mu$m when the developing potential was about 150 V, i.e., the dot width of the toner image becomes insufficient to form an image of good quality. The frequency of the rectangular waveform is preferably in a range from 2 kHz to 6 kHz.

Furthermore, in order to maintain the aforementioned developing gap Gp at a predetermined distance, disk shaped spacer rollers (not shown) having a radius larger than that of the developing roller 3 by the desired developing gap Gp can be arranged at both ends of the developing roller 3 on the same rotation axis as the developing roller 3, so as to contact surfaces of the photoconductor drum 1 at both ends thereof which are outside of the image forming area.

The surface of the aforementioned developing roller 3 may be preferably made of aluminum that is finished by a blasting process using fine uniform metal particles or glass particles. The preferable surface roughness of the developing roller 3 is 1 to 4 $\mu$m RZ, as defined by the JIS (Japanese Industrial Standard). That is, the diameter of a surface indentation on the surface of the developing roller 3 is 1 to 4 $\mu$m. This roughness of 1 to 4 $\mu$m RZ corresponds to 13 to 80% of the particle diameter of the toner 2. Accordingly, the toner 2 cannot be caught by the surface indentation and, therefore, the developing roller 3 smoothly conveys the toner 2. Furthermore, the surface of the developing roller 3 may be coated with resins so as to stabilize a quality of the surface of the developing roller 3 over a period of time. The preferable coating resins are, for example, silicone containing resins and Teflon containing resins. The silicone containing resins give good toner charging performance and the Teflon containing resins give good surface-releasing performance to the developing roller 3. In addition, even when the developing roller 3 has a partially coated surface (for example, the coating resins are put over the aluminum base metal at a certain covering ratio) and the aluminum base metal is partially exposed to the air, the developing operation can also be performed.

Figure 4:
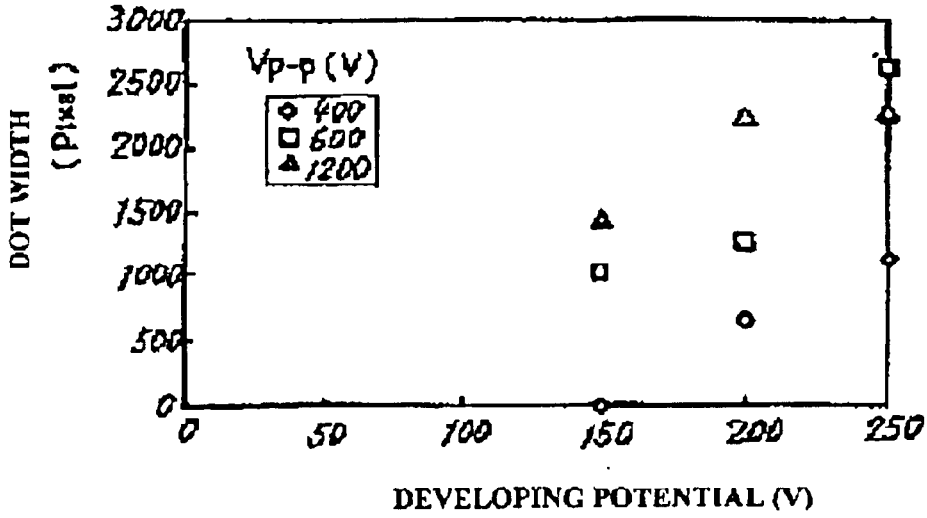
FIG. 4 is a graph illustrating a relationship between the developing potential and a dot area in the developing device of the present invention when a peak-to-peak voltage value of a developing bias voltage is used as a parameter.

Furthermore, the developing bias voltage is applied to the above-described developing roller 3 at the developing gap Gp by a bias power source (not shown), causing the toner to move from the surface of the developing roller 3 to the photoconductor drum 1 across the developing region A. As described above, the developing bias voltage is an AC voltage superimposed on a DC voltage. The preferable value of the peak-to-peak voltage value $V_{p\text{-}p}$ of the AC voltage is from 600 to 1200 V. As illustrated in FIG. 4, when the peak-to-peak voltage value $V_{p\text{-}p}$ of the AC voltage falls below 600 V, the dot area of the developed toner image decreases resulting in deterioration of the image quality. On the other hand, when the peak-to-peak voltage $V_{p\text{-}p}$ of the AC voltage exceeds 1200 V, electric discharging in the air may occur. As known by Paschen's law, the developing bias voltage should not be applied to cause a discharge in the developing gap Gp because this results in significant deterioration of the image quality.

The above-described doctor blade 4 protrudes from a blade holder (not shown) such that a lower surface of the protruded side portion of the doctor blade 4 contacts the surface of the developing roller 3, in a trailing manner relative to the arrow illustrated rotation of developing roller 3. The doctor blade 4 is made of material, for example, stainless steel of SUS 304 in the above-noted JIS and has a thickness of from 0.1 to 0.15 mm. Rubber materials, such as polyurethane rubber and resin materials, such as silicone resins, whose thickness is from 1 to 2 mm can also be used for the doctor blade. A preferable protruding length of the doctor blade 4 from the blade holder toward the developing roller 3 is from 10 to 15 mm. When the protruding length of the doctor blade 4 exceeds the upper limit (15 mm), the size of the developing device becomes large, resulting in the body of the image forming apparatus also becoming large. When the protruding length of the doctor blade 4 falls below the lower limit (10 mm), doctor blade vibration can occur due to friction between the blade and the developing roller 3. If the vibration occurs when a solid image is being formed, a lateral stripe can appear in the image. The preferable contact pressure of the doctor blade 4 relative to the developing roller 3 is from 10 to 150 g/cm. When this contact pressure exceeds the upper limit of 150 g/cm, an adhering amount of the toner 2 on the developing roller 3 decreases and a charging amount of the toner 2 becomes excessive. This causes a decrease in the amount of toner that moves to the photoconductor drum 1 from the developing roller 3, resulting in an unwanted lowering of the image density. When this contact pressure falls below the lower limit of the contact pressure (10 g/cm), the thin layer of the toner 2 is not uniformly formed on the developing roller 3 and coagulated clumps of toner 2 may pass between the doctor blade and roller 3 causing a significant deterioration of the image quality.

An elastic foamed layer is formed on the surface of the toner-supplying roller 5. The elastic foamed layer has numerous openings so that the toner 2 is borne in the openings to roller 3.

The agitator 7 supplies the toner 2 contained in the toner container 6 to the surface of the toner-supplying roller 5, and agitates the toner 2. However, when the toner container 6 is shaped such that the toner 2 is easily supplied to the surface of the toner-supplying roller 5 by its own weight, or the toner 2 has sufficient fluidity to be supplied to the surface of the toner-supplying roller 5 by its own weight, the agitator 7 may be omitted.

In the developing device described above, the agitator 7 supplies the toner 2 contained in the toner container 6 to the surface of the toner-supplying roller 5. The toner 2 supplied by the toner-supplying roller 5 is conveyed to a contacting part of the toner-supplying roller 5 with the developing roller 3 by rotation of the toner-supplying roller 5 in a counter-clockwise direction as illustrated by the arrow on roller 5 in FIG. 2. The toner 2 is charged by friction between the toner-supplying roller 5, the toner 2 itself, and the developing roller 3 at the aforementioned contacting part, and is supplied onto the surface of the developing roller 3. The toner 2 supplied onto the surface of the developing roller 3 is formed as a thin layer and is further charged by friction with the doctor blade 4 acting as a layer-thickness limiting member. Thus, the toner 2 is caused to adhere to the surface of the developing roller 3 with a desired amount of charge and with a desired layer thickness. The toner 2 is then conveyed to the developing region A by a rotation of the developing roller 3.

In the developing region A, the toner 2 on the surface of the developing roller 3 to which the developing bias voltage is applied from the bias power source (not shown) to form an electric field appropriate for the developing operation, moves back and forth between the surface portion of the developing roller 3 and the surface portion of photoconductor drum 1 at the developing region and thereby, an electrostatic latent image is formed on the surface of the photoconducting drum 1. Any of the toner 2 that does not adhere to the photoconductor drum 1 after passing back and forth through the developing region A is returned to the parts of the developing roller 3 because it corresponds to the non-image areas of the latent image on the surface of the photoconductor drum 1. This returned toner 2 is mechanically and electrically removed from the surface of the developing roller 3 by the toner-supplying roller 5. Furthermore, the charge on the developing roller 3 is made uniform by a charge generated by friction between the developing roller 3 and the toner-supplying roller 5, and the charge on the surface of the developing roller 3 is thus initialized to prepare for the next developing operation.

In such a developing device performing a developing operation according to two-level binary image density information for each pixel (hereinafter, referred to as a two-level developing operation), when the developing device develops an image with concentrated dots, such as when only two blank dots are available for every one writing dot in a 600 dpi (dots per inch) image writing operation, if the developing potential is changed, the dot area of the visible image on the photoconductor drum 1 may vary as described before.

To overcome this problem, a developing condition is set such that the amount of the toner 2 that adheres to the photoconductor drum 1 saturates when the developing potential exceeds a certain threshold value. Specifically, the image density is set to 1.5 as a target value when the amount of the toner 2 that adheres to the photoconductor drum 1 is 0.7 mg/cm$^2$. Accordingly, even if the potential is increased above the threshold value, the saturated amount of toner 2 adhering to drum 1 does not increase.

FIG. 1 is a graph illustrating a relationship between the developing potential and the amount of the toner 2 that adheres to the photoconductor drum 1 in the developing device of the present invention. Marks ▭ and Δ in FIG. 1 represent data obtained by an experiment in which the amounts of the toner 2 (m/a) that adhere on the developing roller 3 are set to 0.5 and 1.6 mg/cm$^2$, respectively. When the adhering amount of the toner 2 to the developing roller 3 is set to 0.5 mg/cm$^2$, between 1 to 1.5 layers of particles of toner 2 (the layers are 1 to 1.5 times as thick as the diameter of a toner particle) are formed on the developing roller 3. As shown in FIG. 1 by the marks ▭, the amount of the toner 2 that adheres to the photoconductor drum 1 saturates when the developing potential exceeds a certain value, i.e., about 200 V. Therefore, an ideal two-level developing operation can be performed in which a predetermined density is obtained without producing an image having a dirty background.

On the contrary, when the adhering amount of the toner 2 to the developing roller 3 is set to 1.6 mg/cm$^2$, 3 to 4 layers of the toner are formed on the developing roller 3. As shown in FIG. 1 by the marks Δ, since all of the layers of the toner do not move with the same predetermined developing potential, when the developing potential is increased, the developing amount, i.e., the amount of toner that moves to the photoconductor drum 1 from the developing roller 3, increases as the developing potential is increased. Accordingly, the developing amount varies with a potential variation on the photoconductive drum 1 due to a change of an output of an optical writing system. Therefore, a stable image density cannot be obtained since the amounts of toner deposited are not saturated relative to a threshold potential value.

Figure 5:
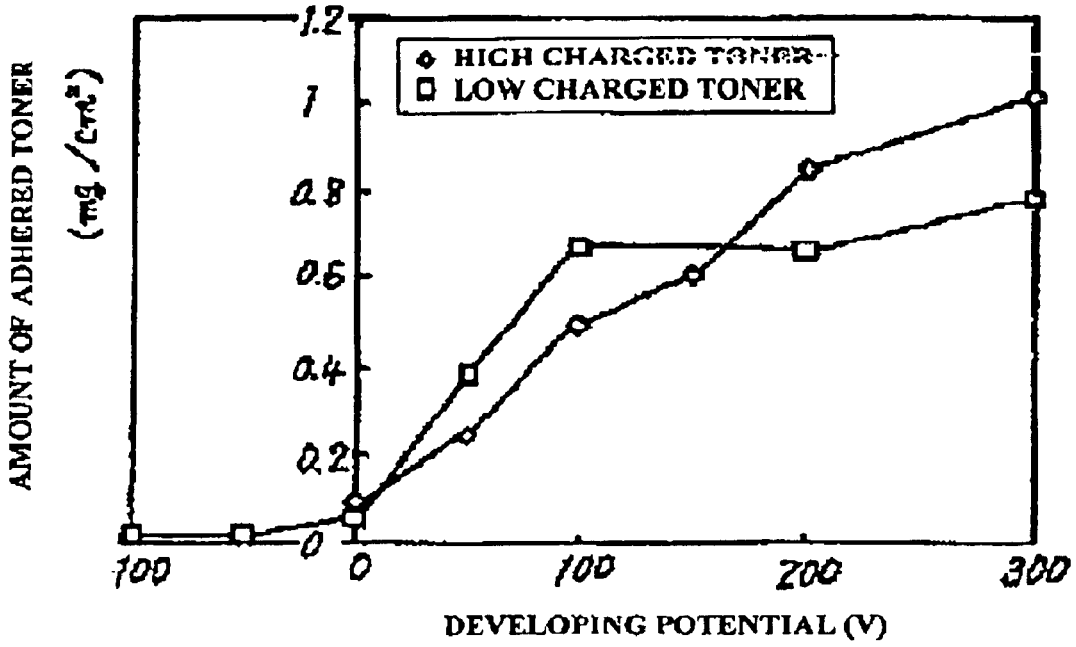
FIG. 5 is a graph illustrating a developing gamma performance of the developing potential and the adhering amount of toners in the developing device of the present invention when a charge amount of toner is used as a parameter.

FIG. 5 illustrates a developing gamma characteristic for two types of toners 2 having different charging amounts (g/m). Marks ◇ and ▭ in FIG. 5 represent data obtained for a high charging amount toner 2 having the charging amount (g/m) of −13 μC/g and a low charging amount toner 2 having the charging amount (g/m) of −8 μC/g, respectively. As can be understood from the data in FIG. 5, the amount of the toner 2 that adheres to the photoconductor drum 1 increases until the developing potential reaches approximately 300 V for the toner 2 having the charging amount (g/m) of −13 μC/g, while the amount of the toner 2 that adheres to the photoconductor drum 1 saturates at the developing potential of approximately 100 V for the toner 2 having the charging amount (g/m) of −8 μC/g. Thus, when an absolute value of the charging amount "g/m" of the toner 2 becomes relatively high, the developing amount changes due to an influence of a change of the potential of the photoconductor drum 1 resulting in a change of image density. On the other hand, it has been determined that when the absolute value of the charging amount is equal to or less than about 10 μC/g, the opposite holds time.

As described above, when a two-level developing operation using a one-component developer is performed under the condition that the amount of toner 2 adhering to a photoconductor drum 1 saturates when the developing potential exceeds a certain threshold value, a stable image density can be obtained regardless of environmental condition and even after a period of time elapse, without producing an image having a dirty background.

Obviously, numerous modifications and variations of the present invention are possible in light of the above teachings. It is therefore to be understood that within the scope of the appended claims, the invention may be practiced otherwise than as specifically described herein.

This document claims priority and contains subject matter related to Japanese Patent Applications No. 11-079824, filed on Mar. 24, 1999, and the entire contents thereof are herein incorporated by reference.

What is claimed is:

1. An image forming apparatus, comprising:

a latent image bearing member having a photoconductive surface with a latent image including image areas, at least some of said image areas having different image potential values thereon; and a developing device configured to perform a two-level developing operation with a one-component developer including toner particles, the developing device including, a conveyor member configured to convey the one-component developer from a one-component developer supply and to deliver the one-component developer with a predetermined amount of charge to a developing region where a conveyor surface portion of the conveyor member is closely spaced from and opposed to a photoconductive surface portion of the latent image bearing member, a thin layer forming device configured to form the one-component developer being conveyed on the conveyor member into a uniform thin layer prior to the one-component developer with the predetermined amount of charge being delivered to the developing region, and a voltage source configured to apply a developing bias voltage to the conveyor member when the two-level developing operation is performed to move at least some of the one-component developer with a predetermined charge adhering to the conveyor surface portion to the photoconductive surface portion to form saturated amounts of the one-component developer on the image areas of the photoconductive surface portion, wherein the saturated amounts do not change with increases of the image potential above a predetermined threshold value to provide an image having a density determined by the saturated amounts.

2. The image forming apparatus according to claim 1, wherein an amount of the one-component developer adhering to the conveyor surface portion is about 0.5 mg/cm$^2$.

3. The image forming apparatus according to claim 1, wherein an absolute value of the predetermined amount of charge of the one-component developer is equal to or less than about 10 μC/g.

4. The image forming apparatus according to claim 1, wherein substantially all of the one-component developer on the conveyor surface portion is moved during the forming of the saturated amounts.

5. The image forming apparatus according to claim 1, wherein the adhering amount of the one-component developer on the conveyor member is formed by the thin layer forming device to be from 1 to 1.5 times the thickness of a diameter of the toner particles.

6. The image forming apparatus according to claim 5, wherein substantially all of the one-component developer on the conveyor surface portion is moved during the forming of the saturated amounts.

7. The image forming apparatus according to claim 1, wherein the development region includes a gap between the conveyor surface portion and the opposed photoconductive surface portion that is equal to or less than about 150 μm.

8. The image forming apparatus according to claim 1, wherein the developing bias voltage applied to the conveyor member by the voltage source is an AC voltage superimposed on a DC voltage, said AC voltage having a peak-to-peak voltage value from 600 to 1200 volts and a frequency from 2 to 6 kHz.

9. The image forming apparatus according to claim 8, wherein at least some image areas of a latent image on the latent image bearing member have different potentials and a developing condition is established to insure that an amount of the one-component developer that adheres to the image areas of the latent image bearing member is saturated for all potentials at or exceeding a predetermined threshold potential so that when an image area of the latent image on the latent image bearing member is at the developing region during the two-level developing operation, substantially all of the one-component developer on the conveyor member that is also at the developing region at the same time is used for the two-level developing operation for forming each saturated amount adhering to the image areas of the latent image.

10. The image forming apparatus according to claim 1, wherein the thin layer forming device protrudes from a holder with a protruding length of 10 to 15 mm.

11. The image forming apparatus according to claim 1, wherein the thin layer forming device contacts the developer-bearing member with a contact pressure of about 10 to about 150 g/cm.

12. The image forming apparatus according to claim 1, wherein a surface roughness of the conveyor member is set from about 1 to about 4 μm RZ.

13. The image forming apparatus according to claim 1, wherein the means for forming the thin layer forms the thin uniform layer of one-component developer on the means for conveying to be from 1 to 1.5 times the thickness of a diameter of the toner.

14. The image forming apparatus according to claim 13 wherein substantially all of the one-component developer on the portion of the means for conveying is moved during the forming of the saturated amounts.

15. An image forming apparatus, comprising:

a latent image bearing member having a potential thereon; and a developing device configured to perform a two-level developing operation with a one-component developer including toner particles, the developing device including, a conveyor member configured to convey the one-component developer to a developing region where part of the developer-bearing member is closely spaced next to a part of the latent image bearing member;

a thin layer forming device configured to form the one-component developer on the conveyor member into a uniform thin layer having a height corresponding to 1 to 1.5 times a diameter of the toner particles of the one-component developer.

16. An image forming apparatus, comprising:

means for bearing a latent image including image areas, at least some of said image areas having different image potential values thereon; and means for performing a two-level developing operation using a one-component developer including toner particles, the two-level developing operation performing means including, means for conveying the one-component developer from a one-component developer supply and to deliver the one-component developer with a predetermined amount of charge to a developing region where a portion of the means for conveying is closely spaced from and opposed to a portion of the means for bearing a latent image, means for forming a uniform thin layer of the one-component developer on the means for conveying prior to the one-component developer with the predetermined amount of charge being delivered to the developing region, and means for applying a developing bias voltage to the means for conveying when the two-level developing operation is performed to move at least some of the one-component developer with a predetermined charge adhering to the portion of the means for conveying to the portion of the means for bearing a latent image to form saturated amounts of the one-component developer on the image areas of the portion of the means for bearing a latent image, wherein the saturated amounts do not change with increases of the image potential above a predetermined threshold value to provide an image having a density determined by the saturated amounts.

17. The image forming apparatus according to claim 16 wherein an amount of the one-component developer adhering to the means for conveying is about 0.5 mg/cm$^2$.

18. The image forming apparatus according to claim 16 wherein an absolute value of the predetermined amount of charge of the one-component developer is equal to or less than about 10 $\mu$C/g.

19. The image forming apparatus according to claim 16 wherein substantially all of the one-component developer on the portion of the means for conveying is moved during the forming of the saturated amounts.

20. The image forming apparatus according to claim 16, wherein the development region includes a gap between the portion of the conveying means and the opposed portion of the means for bearing a latent image that is equal to or less than about 150 $\mu$m.

21. The image forming apparatus according to claim 16, wherein means for applying a developing bias voltage to the means for conveying applies an AC voltage superimposed on a DC voltage, said AC voltage having a peak-to-peak voltage value from 600 to 1200 volts and a frequency from 2 to 6 kHz.

22. The image forming apparatus according to claim 16, wherein the means for forming the uniform thin layer has a portion that protrudes from a holder with a protruding length of 10 to 15 mm.

23. The image forming apparatus according to claim 16, wherein the means for forming the uniform thin layer contacts the means for conveying with a contact pressure of about 10 to about 150 g/cm.

24. The image forming apparatus according to claim 16, wherein a surface roughness of the means for conveying is set from about 1 to about 4 $\mu$m RZ.

25. An image forming apparatus, comprising:

means for bearing a latent image having various potential levels thereon at different image areas; and means for performing a two-level developing operation using a one-component developer including toner particles, the two-level developing operation performing means including, means for conveying the one-component developer to a developing region where part of the means for conveying is closely spaced next to the means for bearing a latent image, and means for forming the one-component developer on the means for conveying into a uniform thin layer having a height corresponding to 1 to 1.5 times a diameter of the toner particles.

26. The image forming apparatus according to claim 25, wherein a developing condition is established to insure that an amount of the one-component developer that adheres to the image areas of the means for bearing a latent image is saturated for all the various potential levels at or exceeding a predetermined threshold potential level so that when an image area of the latent image on the means for bearing a latent image is at the developing region during the two-level developing operation, substantially all of the one-component developer on the means for conveying that is also at the developing region at the same time is used for the two-level developing operation for forming each saturated amount adhering to the image areas.

27. A method for performing a two-level developing operation in an image forming apparatus hang a latent image bearing member having a photoconductive surface with a latent image including image areas, at least some of said image areas having different image potential values thereon and a developing device having a conveyor member, comprising the steps of:

providing a one-component developer including toner particles;

forming the one-component developer into a uniform thin layer on the conveyor member;

providing the one-component developer with a predetermined amount of charge and conveying the one-component developer with a predetermined amount of charge to a developing region with the conveyor member so that a conveyor surface portion of the conveyor member is closely spaced from and opposed to a photoconductive surface portion of the latent image bearing member at the developing region; conveyor member is closely spaced from and opposed to a photoconductive surface portion of the latent image bearing member at the developing region;

applying a developing bias voltage to the conveyor member and causing at least some of the one-component developer with the predetermined amount of charge adhering to the conveyor surface portion to move to the photoconductive surface portion to form saturated amounts of the one-component developer on the image areas of the photoconductive surface portion, wherein the saturated amounts do not change with increases of the image potential above a predetermined threshold value to provide an image having a predetermined density determined by the saturated amounts.

* * * * *